US007025353B2

(12) United States Patent
Lydick

(10) Patent No.: US 7,025,353 B2
(45) Date of Patent: Apr. 11, 2006

(54) HORSE RACING BOARD GAME

(76) Inventor: Martha I. Lydick, 1284 Coronado Dr., Laguna Beach, CA (US) 92651

( * ) Notice: Subject to any disclaimer, the term of this patent is extended or adjusted under 35 U.S.C. 154(b) by 0 days.

(21) Appl. No.: 10/294,523

(22) Filed: Nov. 13, 2002

(65) Prior Publication Data

US 2004/0090001 A1 May 13, 2004

(51) Int. Cl.
*A63F 3/00* (2006.01)

(52) U.S. Cl. ..... 273/246; 273/249

(58) Field of Classification Search ..... 273/246, 273/249

See application file for complete search history.

(56) References Cited

U.S. PATENT DOCUMENTS

| | | | | |
|---|---|---|---|---|
| 2,026,082 A | | 12/1935 | Darrow | |
| 3,883,143 A | * | 5/1975 | Kelley et al. | 273/246 |
| 3,951,412 A | | 4/1976 | Adams | |
| 3,963,243 A | | 6/1976 | Contento | |
| 4,057,254 A | | 11/1977 | Girres | |
| 4,093,238 A | | 6/1978 | Moskowitz | |
| 4,874,177 A | * | 10/1989 | Girardin | 273/246 |
| 4,986,546 A | | 1/1991 | Cerulla | |
| 5,106,098 A | | 4/1992 | Filiczkowski | |
| 5,226,655 A | | 7/1993 | Rickabaugh | |
| 5,383,669 A | * | 1/1995 | Vance | 273/244 |
| 5,437,459 A | | 8/1995 | Kirby | |
| 5,551,699 A | | 9/1996 | Pavelich | |
| 5,853,173 A | | 12/1998 | Murphy | |

OTHER PUBLICATIONS

Ex.parte Breslow 192 USPQ 431.*

* cited by examiner

*Primary Examiner*—Vishu K. Mendiratta
(74) *Attorney, Agent, or Firm*—Christie, Parker & Hale, LLP

(57) ABSTRACT

A game is provided in which a horse race is simulated. The game layout includes a contiguous lane divided into a plurality of spaces, each of which is designated with a particular task or event. A unique space, designated the Winner's Circle, is located at or near the center of the board and is connected to the contiguous lane by at least one space, designated the Stretch. A player's token moves around the board a number of spaces within the lane according to the outcome of a random number generator. A player landing on a space will take one of a series of action determined by the designation of the space on which his or her token lands. Three sets of spaces, designated WIN, PLACE or SHOW, direct the player to answer a horse racing trivia question selected at random by another player. If the player answers correctly, he or she is awarded a pari-mutual ticket, which is used to place a wager on a simulated horse race. Simulated horse races are run whenever a player lands on a space designated for a race. Players who successfully bet on a simulated horse race are awarded game money and, when sufficient game money is accumulated, may leave the contiguous lane and enter the Stretch and the Winner's Circle. The first player to enter the Winner's Circle and successfully answer a horse racing trivia question is the winner of the game.

30 Claims, 12 Drawing Sheets

114

116

This multiple stakes winner was foaled on Friday the thirteenth. Was it...

a. Fabius
b. Swoon's Son
c. Dark Star

Swoon's Son won 6 in a row as a juvenile.

This jockey won four stake races on the same day. Was it...

a. Alex Solis
b. Corey Nakatani
c. Chris McCarron

On Cal Cup Day, Alex Solis won the Distaff Starter, Distaff, Spring and Juvenile Fillies stakes.

What does it mean when a horse is "stuck"?

a. He can't get out of the gate
b. He stays in his stall
c. He may not be scratched from the race

No horse may be scratched from a stakes race if it would reduce the number of entrants to 7 or less.

118

In 1918 the Riddles purchased this famous horse for $5,000. Name him...

The Riddles thought Man O' War would make a good hunter. The average price for a horse at the Saratoga sales that year was $1,000.

Who was the first jockey to win the $1 million Dubai World Cup? Was it...

a. Gary Stevens
b. Jerry Bailey
c. Pat Day

Jerry Bailey and Cigar won the inaugural running of the Dubai Cup.

She was the first filly to run all three Triple Crown races. Was it...

a. Genuine Risk
b. Grand Risa
c. Image of Reality

Genuine Risk won the Derby and placed in the Preakness and Belmont.

Who won the famous match race between War Admiral and Seabiscuit?

Seabiscuit won and kept War Admiral, the 1937 Triple Crown winner from becoming Horse of the Year.

122

This thoroughbred won Horse of the Year three times. Was it...

a. Secretariat
b. John Henry
c. Forego

Forego won in 1974 at age four, 1975 and 1976.

The Kentucky Derby has always been on the first Saturday in May. True or False?

False. Hoop, Jr. won the Derby in June 1945. The Derby was run in June that year because of WWII.

120

FIG. 3

148

| | | |
|---|---|---|
| ROLL AGAIN NOW | YOUR HORSE WAS SCRATCHED ON THE WAY TO THE GATE. LOSE A TURN. | YOU OVERHEARD A HOT TIP - ROLL DIE. IF EVEN-RECEIVE PLACE CARD. |
| TOUR BREEDING FARM. GO TO THE KEENELAND SALES AND ADVANCE 3 SPACES. | YOU'VE BEEN INVITED TO VISIT YOUR FAVORITE TRAINER'S BARN. RECEIVE SHOW CARD. | YOUR HORSE WAS TRAPPED BUT BREAKS FREE AT THE STRETCH. RECEIVE SHOW CARD. |
| YOUR CRITICISM OF THE SHEIK'S HORSE INCURRED HIS WRATH. LOSE A TURN. | YOUR FILLY IS THE ENVY OF YOUR FRIENDS. GO TO THE WALKING RING. | ROLL DIE IF ODD-LOSE ONE WIN CARD. |
| WHILE DINING AT THE TURF CLUB-YOU MEET THE LEADING OWNERS. GO BACK THREE SPACES. | YOUR HORSE WAS NECK IN NECK IN THE STRETCH. RECEIVE A PLACE CARD. | YOUR FEED BILL IS OVERDUE. LOSE A TURN. |
| YOUR THREE-YEAR-OLD IS RUNNING BEAUTIFULLY. RECEIVE WIN CARD. | THE LEADING SOUTHERN CALIFORNIA TRAINER INVITES YOU TO THE PREAKNESS. RECEIVE TRIFECTA TICKET. | YOU HAVE BEEN INVITED TO PRESENT THE TROPHY. RECEIVE TRIFECTA TICKET. |
| STEWARDS OVERTURN YOUR DISQUALIFICATION. KEEP CARD UNTIL NEEDED. WHEN USED REPLACE AT BOTTOM OF STACK. | CONNECTIONS OF LAST YEAR'S KENTUCKY DERBY INVITE YOU TO SPEND THE FIRST SATURDAY IN MAY IN THEIR PRIVATE BOX. RECEIVE EXACTA TICKET. | YOU GET YOUR 6 PICK WIN PARLEY. RECEIVE WIN TICKET |
| YOU'VE BEEN ON THE TURF CLUB WAITING LIST A LONG TIME-YOU GET THE CALL-YOU'RE IN. RECEIVE WIN TICKET. | YOU ENTER YOUR FAVORITE HORSE IN THE KENTUCKY DERBY. WIN EXACTA TICKET. | YOU WIN THE BID AT THE YEARLING SALES. RECEIVE WIN TICKET. |
| YOU'RE INVITED TO THE CALLER'S AERIE. GO BACK THREE SPACES. | GO TO THE KEENELAND SALES. BID ON SILVER CHARM COLT. ROLL DICE-IF EVEN-RECEIVE A WIN TICKET. | YOU GET YOUR 6 PICK PLACE PARLEY. GET PLACE TICKET. |
| YOU GET YOUR 6 PICK SHOW PARLAY. RECEIVE SHOW TICKET. | WHILE STANDING AT THE WALKING RING-A JOCKEY WINKS AT YOU. ROLL DICE IF EVEN RECEIVE WIN TICKET. | |

FIG. 7

150

| | | |
|---|---|---|
| THE STEWARDS RULED . . . YOUR HORSE WAS SCRATCHED BECAUSE IT DID NOT MATCH THE ID MARKINGS. LOSE WIN TICKET. | THE STEWARDS RULED . . . THE VIDEO SHOWED YOUR JOCKEY HOOKING HIS LEG OVER OTHER JOCKEY'S LEG. LOSE WIN TICKET. | THE STEWARDS RULED . . . YOUR JOCKEY USED A BUZZER; DISQUALIFIED FROM FIRST TO LAST. LOST WIN TICKET. |
| THE STEWARDS RULED . . . THOUGH YOUR HORSE CROSSED THE FINISH LINE FIRST, THE JOCKEY WAS NOT ON HIS BACK. LOSE A TURN. | THE STEWARDS RULED . . . BY ORDER OF THE VET . . . TO SCRATCH YOUR HORSE. LOSE A TURN. | THE STEWARDS RULED . . . IT WAS TAKING TOO LONG TO SHOE YOUR HORSE AFTER HE LOST HIS SHOW IN THE POST PARADE. LOSE A TURN. |
| THE STEWARDS RULED . . . AFTER STUDYING THE PHOTO-A DEAD HEAT. ADVANCE 3 SPACES. | THE STEWARDS RULED THE VIDEO WAS INCONCLUSIVE. NO CHANGE. | THE STEWARDS RULED . . . YOUR HORSE INTERFERED WITH ANOTHER HORSE BUT MADE NO DIFFERENCE TO THE OUTCOME OF THE RACE. NO CHANGE. |
| THE STEWARDS RULED . . . YOUR HORSE INTERFERED WITH ANOTHER HORSE. LOSE A SHOW CARD. | THE STEWARDS RULED . . . YOUR JOCKEY USED HIS WHIP ON ANOTHER JOCKEY. LOSE A WIN CARD. | THE STEWARDS RULED . . . YOUR HORSE CUT OFF ANOTHER HORSE IN THE FINAL TURN. LOSE A TURN. |
| THE STEWARDS RULED . . . YOUR JOCKEY GRABBED AND HELD ON TO ANOTHER JOCKEY'S SADDLE CLOTH. LOSE AN EXACTA TICKET. | THE STEWARDS RULED . . . YOUR JOCKEY MADE EXCESSIVE USE OF HIS WHIP. LOSE WIN TICKET. | THE STEWARDS RULED IN YOUR FAVOR WHEN YOUR HORSE WAS BUMPED IN THE STRETCH. ROLL AGAIN. |
| THE STEWARDS RULED . . . YOUR STIRRUPS GOT CAUGHT IN ANOTHER JOCKEY'S STIRRUPS. LOSE A PLACE CARD. | THE STEWARDS RULED . . . YOUR HORSE TESTED POSITIVE FOR A FOREIGN SUBSTANCE. LOSE PLACE TICKET. | THE STEWARDS RULED . . . YOUR JOCKEY WITH SADDLE WEIGHED LESS AFTER RACE. LOSE SHOW TICKET. |
| THE STEWARDS RULED . . . YOUR JOCKEY ELBOWED ANOTHER JOCKEY. LOSE PLACE TICKET. | THE STEWARDS RULED . . . YOUR HORSE CAUSED INTERFERENCE AND WAS DISQUALIFIED FROM SECOND TO FOURTH. LOSE A PLACE TICKET. | |

FIG. 8

HORSE RACING BOARD GAME

FIELD OF THE INVENTION

This invention relates to parlor games, and more particularly to a horse racing board game involving strategy, knowledge and skill, together with the element of chance, and having both educational and entertainment value.

BACKGROUND

Games played using a layout displayed on a board are well known in the art. An early example of such a "board game" is the game MONOPOLY®, U.S. Pat. No. 2,026,082.

Board games with a horse racing theme are also known in the art. Examples include U.S. Pat. Nos. 3,951,412; 3,963,243; 4,057,254; 4,093,238; 4,874,177; 4,986,546; 5,106,098; 5,226,655; 5,437,459; 5,551,699; and 5,853,173.

In view of the widespread enthusiasm for horse racing, a board game with a horse racing theme that also tests knowledge of horse racing history is desirable as an entertainment and educational tool.

SUMMARY

The present invention is directed to a horse racing history and trivia game, which includes one or more of the following features:

a game board having a track layout and a winner's circle, wherein the track layout comprises a plurality of spaces and the winner's circle is connected to the track layout by at least one additional space;

at least two playing tokens;

means for randomly determining the number of spaces the playing token may advance for a turn;

a plurality of action cards;

a plurality of trivia cards;

a plurality of pari-mutual wager tickets; and means for simulating a horse race.

In one embodiment, the playing tokens depict individual race horses, each bearing a unique mark, such as color or number, for identifying individual players in the game. Typically, a pair of dice are thrown by each player to determine the number of spaces their token may be moved during each turn. Depending on the space upon which the token lands, the player will take one of several actions.

In another embodiment, designated spaces direct the player to select a trivia card, on which are questions and answers related to horse racing history and trivia. If the player successfully answers the question, he or she may be awarded a pari-mutual ticket that may be used to place bets on simulated horse races. Other designated spaces direct the player to draw an action card, on which are printed instructions to the players. These instructions may include, for example, directions to forfeit a turn or to select a pari-mutual ticket.

Simulated horse races may be conducted whenever a playing token lands on a specially designated space. In one embodiment, the horse race may be simulated by simultaneously throwing multiple dice, each die formed of a different color to represent different horse post positions. Prior to throwing the dice, players holding pari-mutual tickets may select a horse/post position by color and place a bet on that horse. In another embodiment, odds are established for the race prior to throwing the dice using, for example, a spinnable odds wheel.

In one embodiment, players who win bets on the simulated race may collect game money. If odds have been established prior to the race, game money is awarded according to the odds for that race.

In another embodiment, game play continues until a player accumulates enough game money to leave the track and enter the winning circle, where that player must successfully answer a final question before being declared the game winner.

BRIEF DESCRIPTION OF THE DRAWINGS

FIG. 3 is an elevation view showing examples of the various trivia, or question and answer, cards to be drawn by the players when their horse token lands on a WIN, PLACE or SHOW space;

FIG. 7 is a elevation view showing various so called Walking Ring cards to be drawn by players when the horse tokens land on a walking ring square;

FIG. 8 is an elevation view showing various so called Steward cards to be drawn by players when their horse token lands on a Steward square;

DETAILED DESCRIPTION

The present invention provides a parlor game based on a theme of horse racing which adds interest and entertainment value to the game. The game also preferably involves numerous strategy decisions and arithmetic calculations, as well as knowledge of horse racing trivia and history, which provides educational value to the players in addition to being entertaining.

Figure 1:
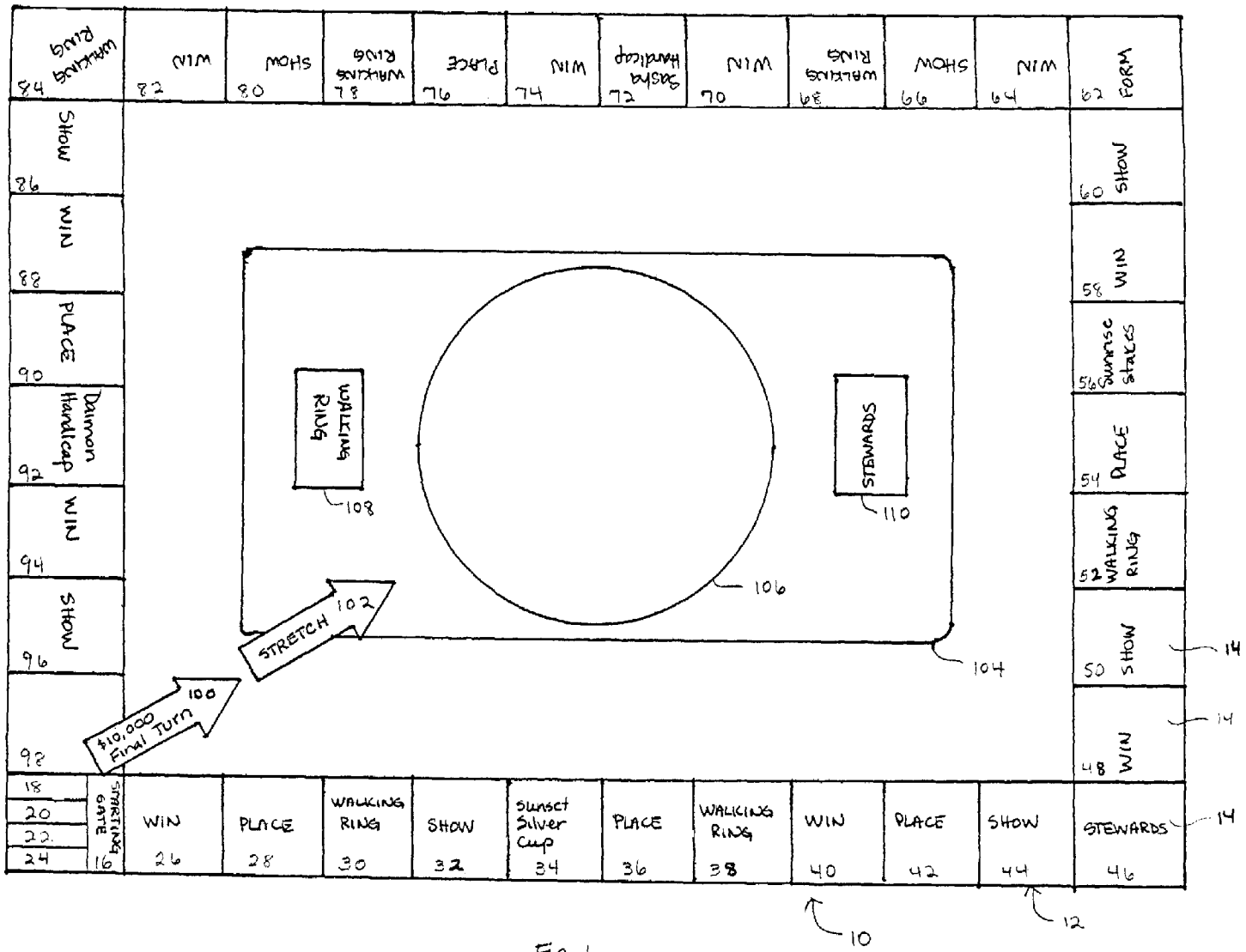
FIG. 1 is a plan view showing the preferred arrangement of the game board of this invention.

Referring to FIG. 1, an exemplary embodiment includes a game board 10 containing a track 12 located around the outside of the game board. The track 12 is divided into squares 14. One square 16, labeled the starting gate, is further divided into four lanes 18, 20, 22, and 24. Several of the squares 14 are labeled "WIN" (26, 40, 48, 58, 64, 70, 74, 82, 88, 94), "PLACE" (28, 36, 42, 54, 76, 90) or "SHOW"

(32, 44, 50, 60, 66, 80, 86, 96). Other squares 14 are labeled "WALKING RING" (30, 38, 52, 68, 78, 84), "STEWARDS" (46) or "FORM" (62). Finally, four squares are designated as "race" squares, labeled Sunset Silver Cup (34), Sunrise Stakes (56), Sasha Handicap (72), or Daimon Handicap (92).

At the center of the board, located within the track, is a ring 104. The ring contains a representation of the winner's circle 106. Preferably, the ring also includes a space 108 labeled Walking Ring and a space 110 labeled Stewards, where a set of "Walking Ring cards" and "Stewards cards" are placed, respectively, as described below. The track 12 is connected to the winner's circle 106 by two spaces 100 and 102, preferably labeled the $10,000 Final Turn and the Stretch, respectively, which extend from the square 98, located immediately clockwise to the starting gate 16, to the winner's circle 106.

Figure 2:
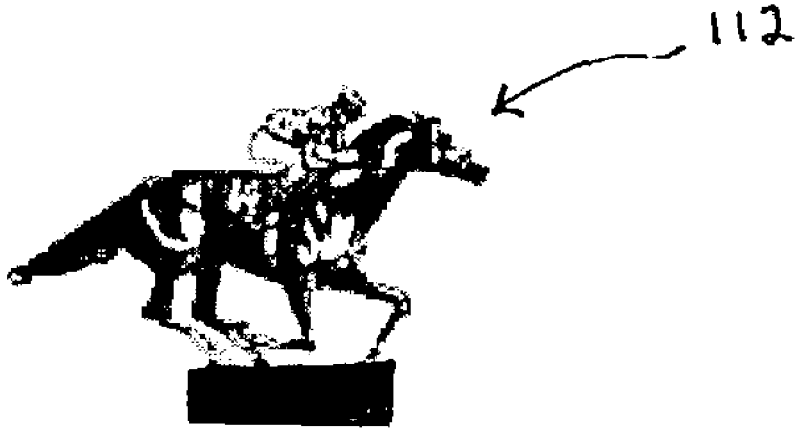
FIG. 2 is a perspective view showing one of a variety of horse tokens for representing the various players of the game.

FIG. 2 shows one of several tokens 112 for use in representing the various players of the game. Each token preferably is shaped as a horse, with the color of the horse serving to distinguish the various players. Alternatively, the horses can be in different positions or sizes to distinguish the players. In still another embodiment, the horse token bears a jockey, with the color or number of the jockey's jersey serving to distinguish the players.

FIG. 3 shows a sample of Question and Answer cards 114. Each question and answer card contains a single question regarding horse racing history or trivia printed on the face of the card. The question may be in the form of a multiple choice 116, short answer 118, or true/false 120. The answer 122 to each question is printed at the bottom of the face of the card. Other examples of Questions and Answers suitable for use in the game are attached as Appendix 1. Additional suitable questions will be apparent to one with knowledge of horse racing and horse racing history.

Figure 4:
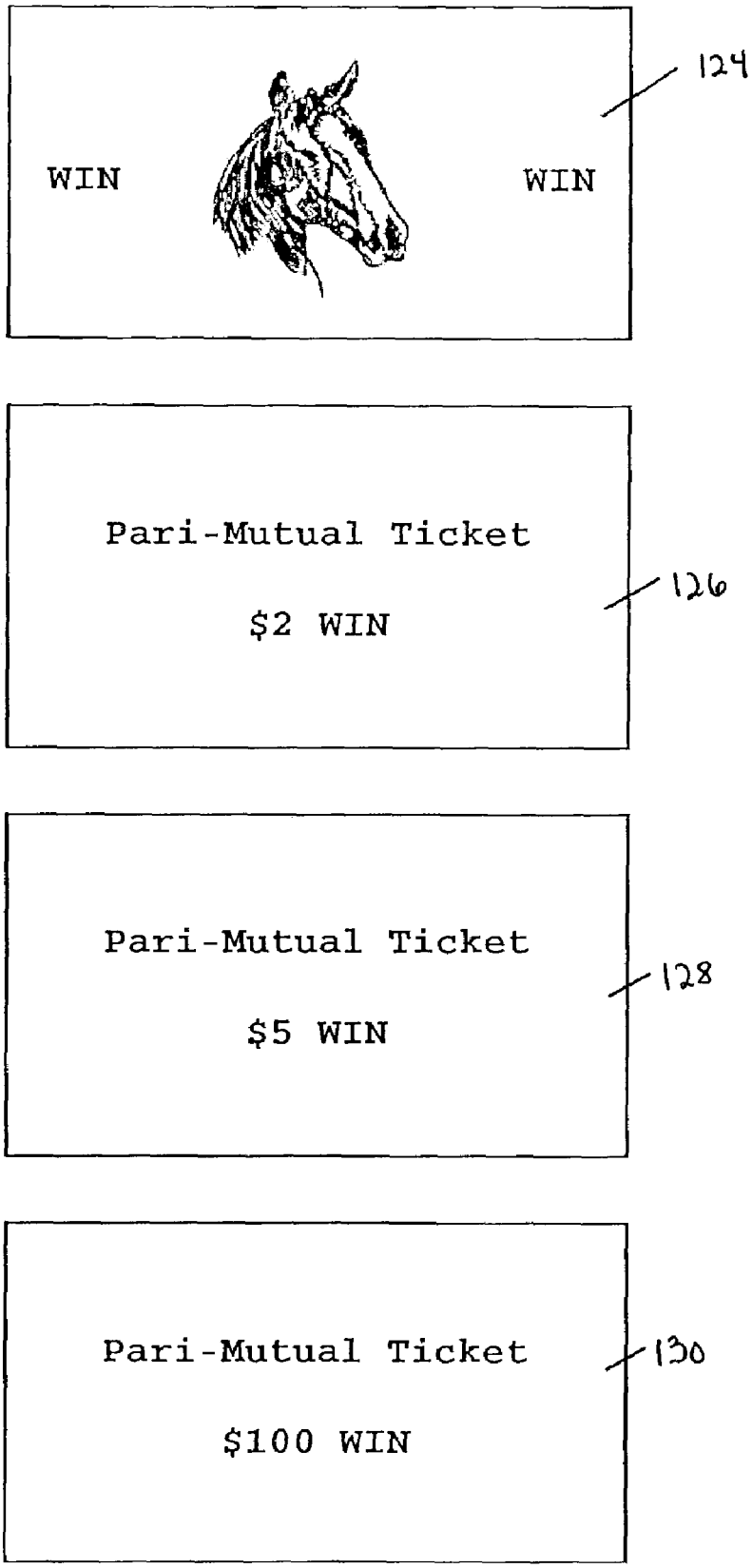
FIG. 4 is an elevation view showing the various so-called WIN pari-mutual tickets which are awarded to players who successfully answer a question on a question and answer card drawn after landing on WIN space.

FIG. 4 shows examples of WIN pari-mutual tickets awarded to players landing on WIN squares who successfully answer a Question and Answer card. The WIN pari-mutual tickets have a "back" side 124, labeled WIN and optionally including an illustration of a horse or other horse race-related illustration, and a "face" side, labeled with various money denominations, such as $2 (126), $5 (128) and $100 (130). Other denominations may also be used.

Figure 5:
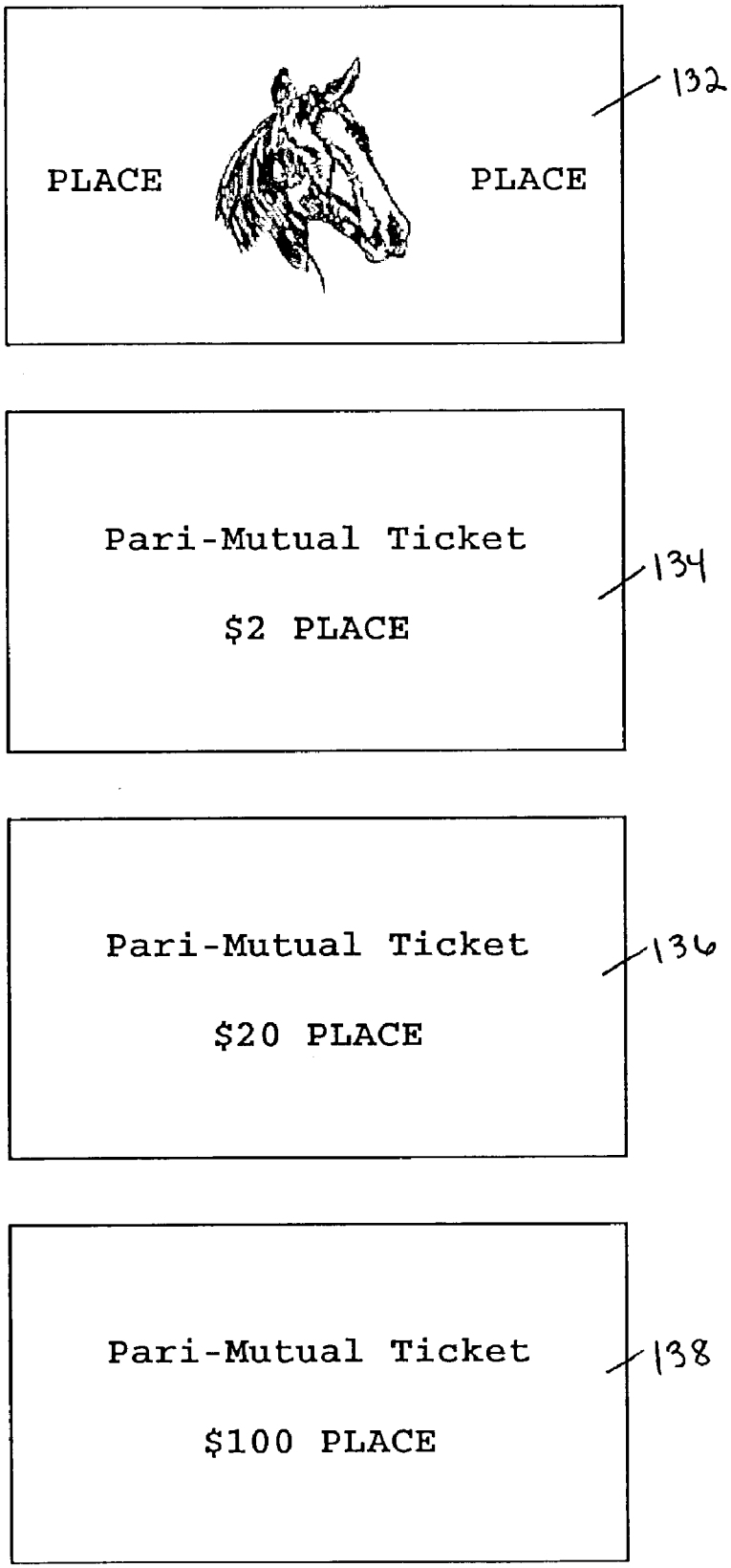
FIG. 5 is an elevation view showing the various so-called PLACE pari-mutual tickets which are awarded to players who successfully answer a question on a question and answer card drawn after landing on PLACE space.

FIG. 5 shows examples of PLACE pari-mutual tickets awarded to players landing on PLACE squares who successfully answer a Question and Answer card. The PLACE pari-mutual tickets have a "back" side 132, labeled PLACE and optionally including an illustration of a horse or other horse race-related illustration, and a "face" side, labeled with various money denominations, such as $2 (134), $20 (136) and $100 (138). Other denominations may also be used.

Figure 6:
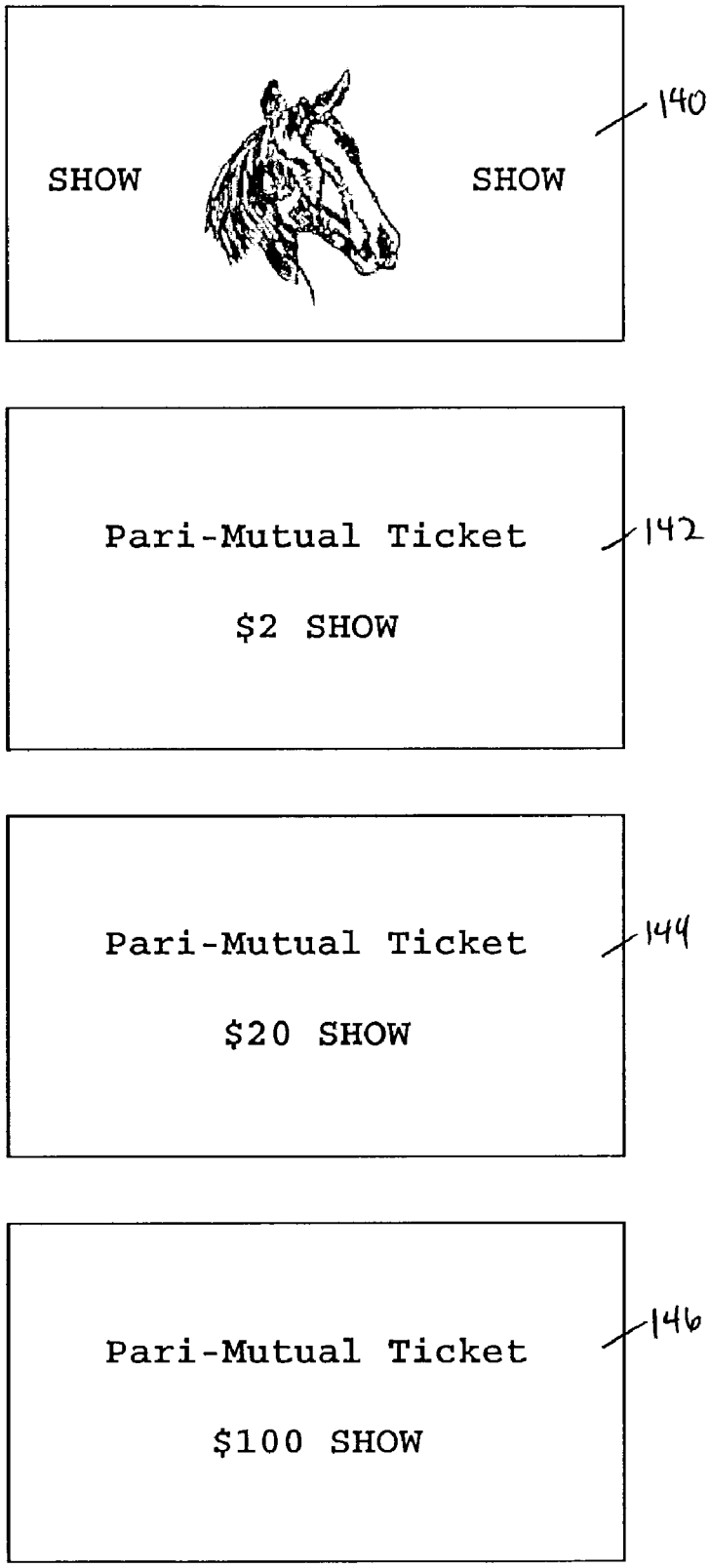
FIG. 6 is an elevation view showing the various so-called SHOW pari-mutual tickets which are awarded to players who successfully answer a question on a question and answer card drawn after landing on SHOW space.

FIG. 6 shows examples of SHOW pari-mutual tickets awarded to players landing on SHOW squares who successfully answer a Question and Answer card. The SHOW pari-mutual tickets have a "back" side 140, labeled SHOW and optionally including an illustration of a horse or other horse race-related illustration, and a "face" side, labeled with various money denominations, such as $2 (142), $20 (144) and $100 (146). Other denominations may also be used.

FIG. 7 shows examples of Walking Ring cards 148, drawn when a player's token lands on a WALKING RING square. A player who draws a Walking Ring card follows the instructions printed on the face side of the card. Some Walking Ring cards provide a benefit to the player, such as awarding a pari-mutual ticket. Other Walking Ring cards are detrimental; for example, some Walking Ring cards direct the player to skip a turn. Optionally, some Walking Ring cards may award game money to the player.

FIG. 8 shows an example of Stewards cards 150, drawn when a player's token lands on a STEWARDS square. These cards contain "rulings" by the Stewards on the face of the cards, which are applied to players drawing a Stewards card. Although some of the Stewards cards contain rulings favorable to the player, most are unfavorable as, for example, where a player is directed to forfeit a pari-mutual ticket.

Figure 9:
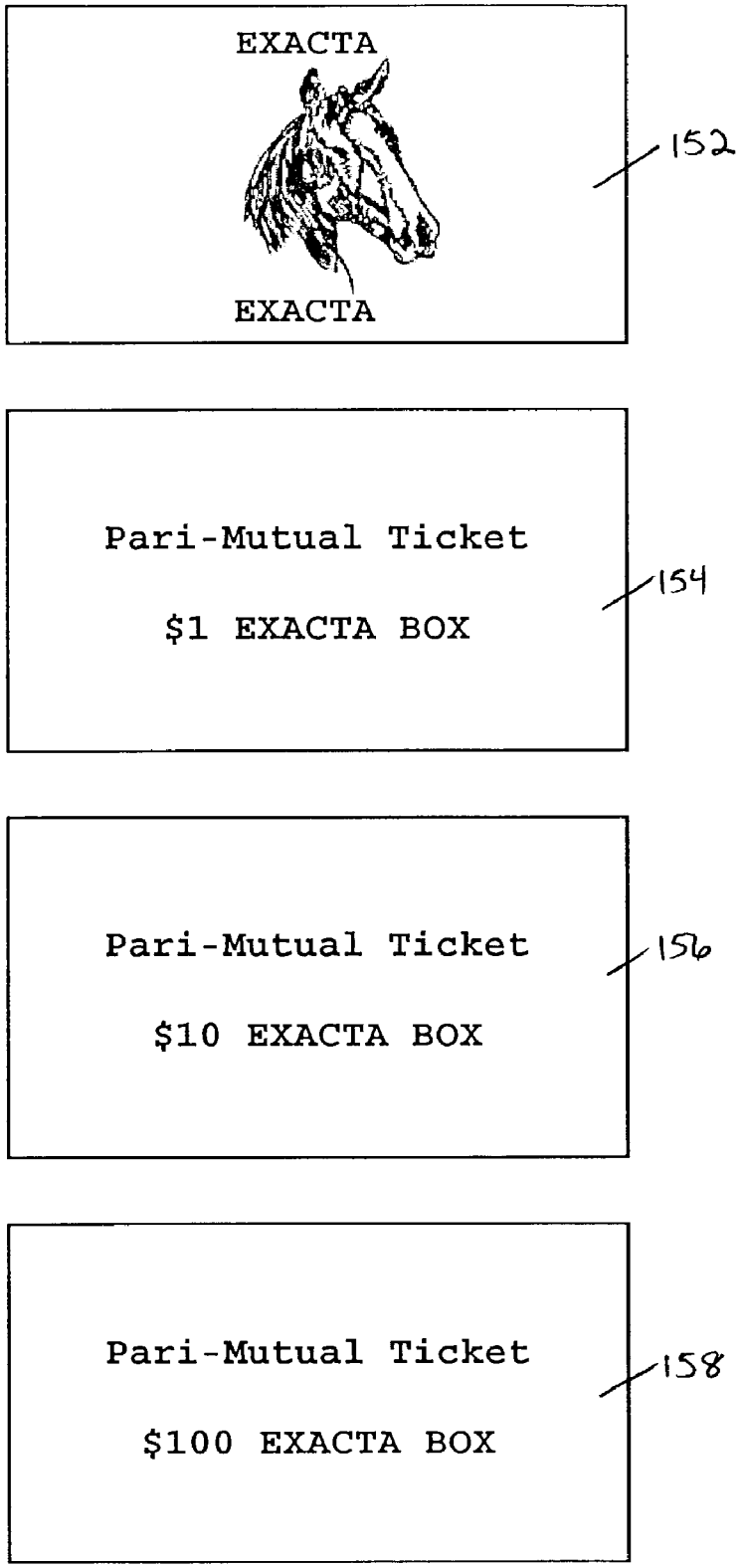
FIG. 9 is an elevation view showing the various so called Exacta Pari-mutual cards to be awarded by players who have drawn a Steward card awarding the Exacta.

FIG. 9 shows examples of EXACTA pari-mutual tickets awarded to players drawing certain Walking Ring cards. The EXACTA pari-mutual tickets have a "back" side 152, labeled EXACTA and optionally including an illustration of a horse or other horse race-related illustration, and a "face" side, labeled with various money denominations, such as $1 (154), $10 (156) and $100 (158). Other denominations may also be used.

Figure 10:
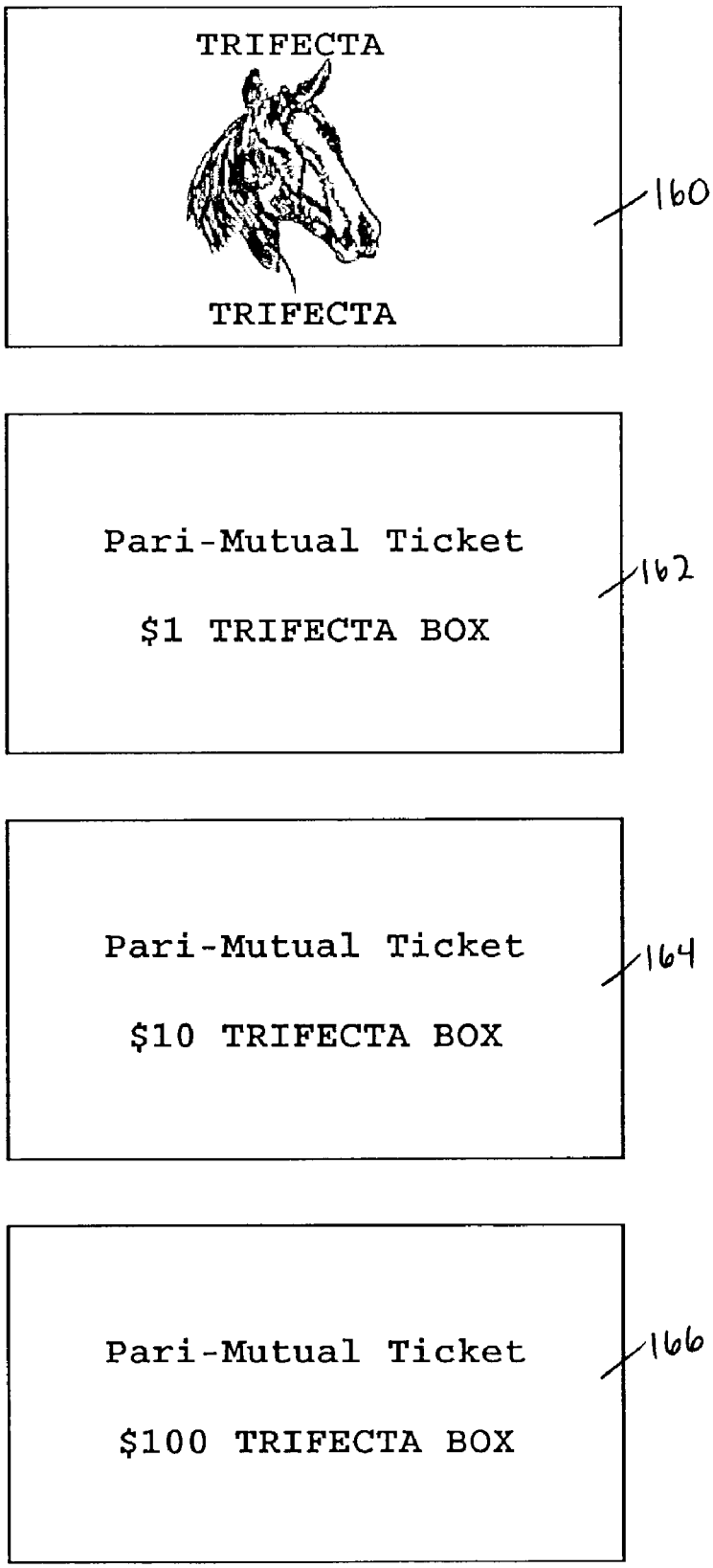
FIG. 10 is a elevation view showing various so called Trifecta Pari-mutual cards to be awarded to players who have drawn a Steward card awarding the Trifecta card.

FIG. 10 shows examples of TRIFECTA pari-mutual tickets awarded to players drawing certain Walking Ring cards. The TRIFECTA pari-mutual tickets have a "back" side 160, labeled TRIFECTA and optionally including an illustration of a horse or other horse race-related illustration, and a "face" side, labeled with various money denominations, such as $1 (162), $10 (164) and $100 (166). Other denominations may also be used.

Figure 11:
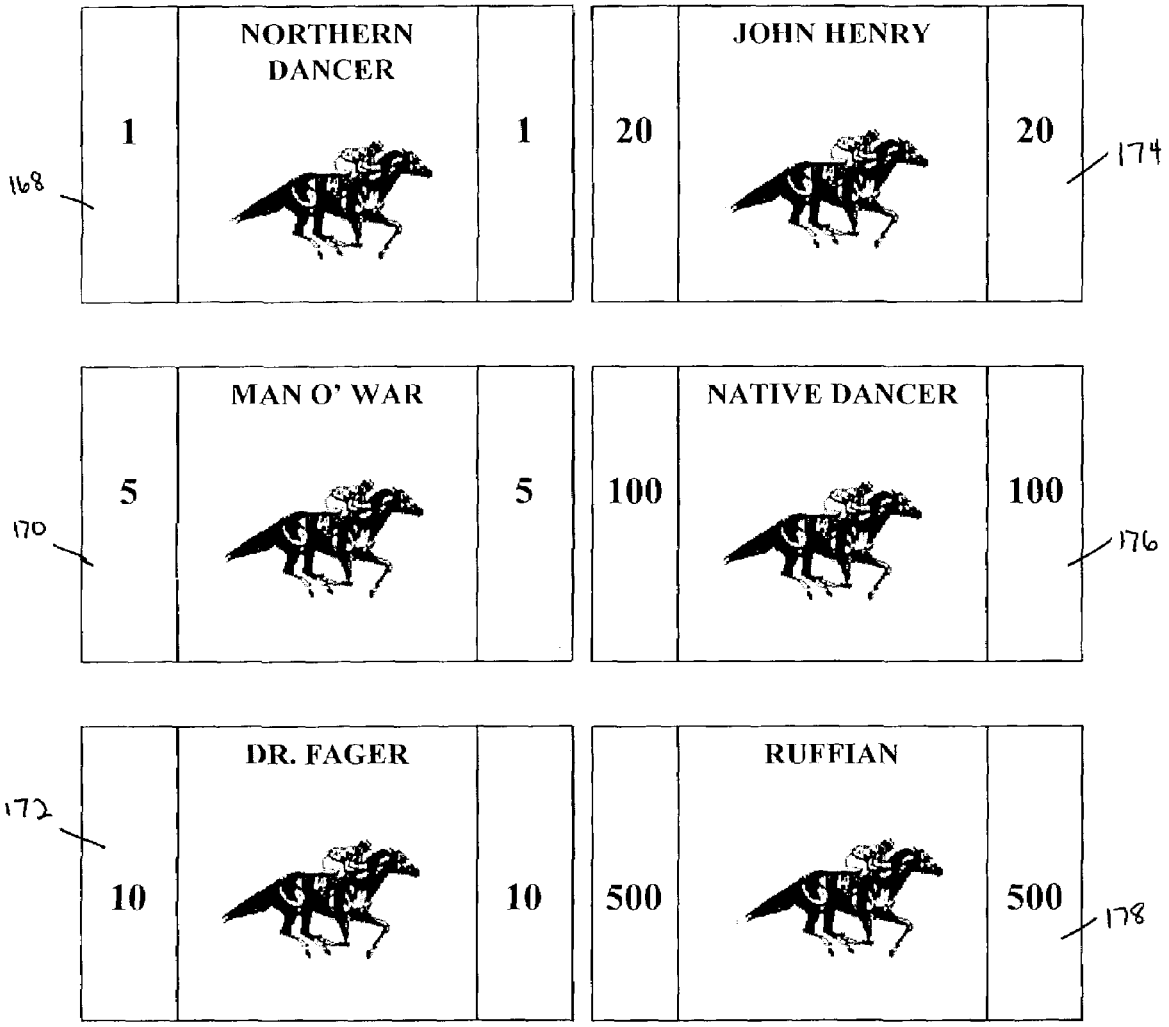
FIG. 11 is an elevation view showing the various denominations of token money to be used by the players during the play of the game.

Game money awarded during play of the game is shown in FIG. 11. Preferably, there are 6 denominations of game money: $1.00 (168), $5.00 (170), $10.00 (172), $20.00 (174), $100.00 (176), and $500.00 (178). In the embodiment shown in FIG. 11, each denomination of game money is indicated by a different horse which has earned a place in racing history. For example, the game money shown in FIG. 11 contains the following famous race horses: Northern Dancer (168), Man O' War (170), Dr. Fager (172), Go For Wand (174), Native Dancer (176) and Ruffian (178). Preferably, the game money does not include a $50.00 denomination as that denomination is considered unlucky in horse racing.

Figure 12:
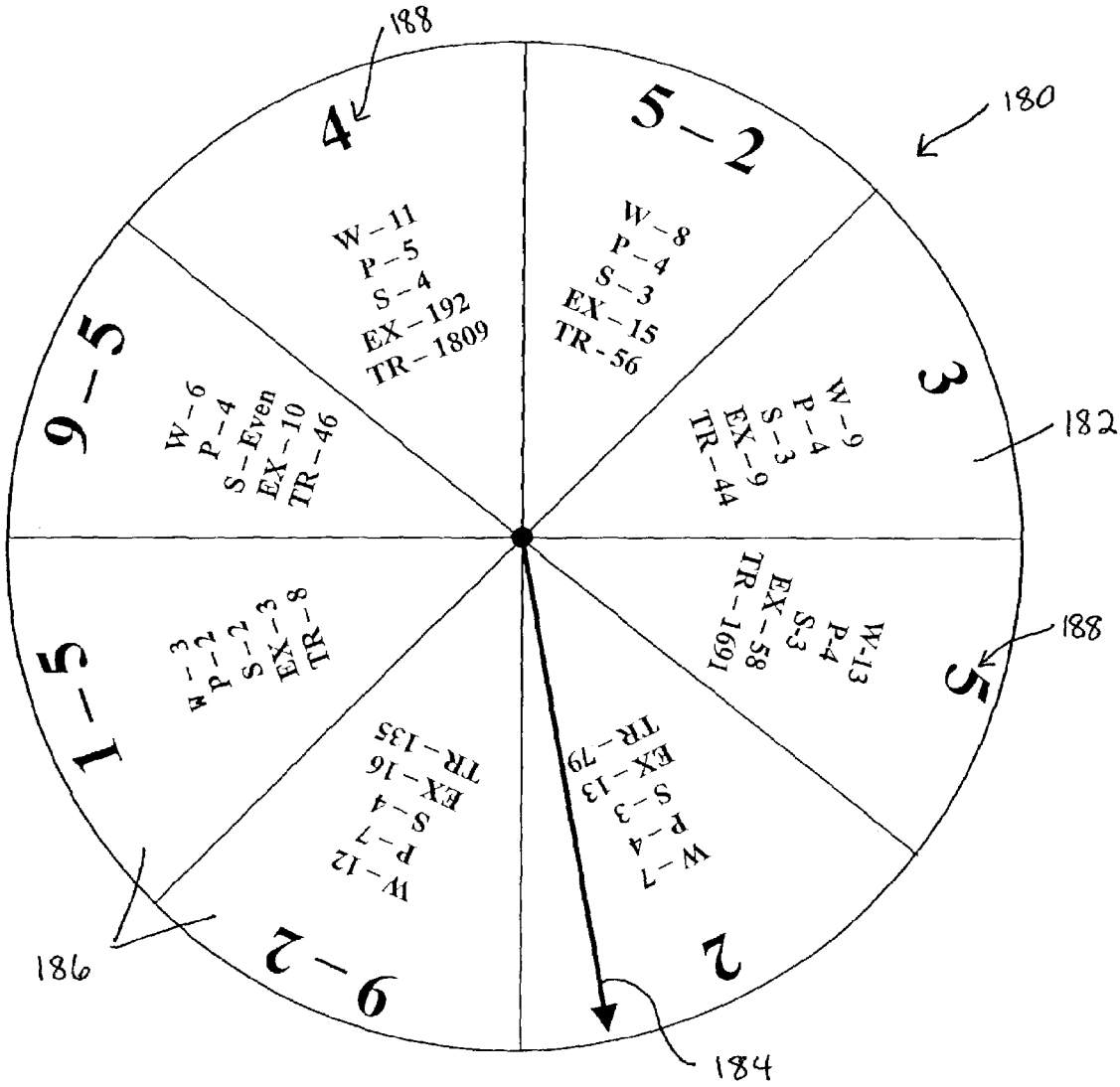
FIG. 12 is an elevation view of a form of an Odds Wheel for establishing the odds for a horse race.

FIG. 12 shows one embodiment of an Odds Wheel 180. The Odds Wheel in this embodiment includes a circular face 182, with a spinner 184 rotatably mounted thereon. The face is divided into eight "pie-shaped" sections 186, although fewer or more sections are also contemplated. Each section is labeled with a different "Odds" 188, with the pay-off 190 for each Odds, based on a $2.00 wager, shown below the Odds. In FIG. 12, for example, the pay-off at a 4:1 Odds (188) for a $2.00 Win wager is $11.00, while the pay-off for a $2.00 Trifecta wager is $1,809.00.

The main purpose of the game is for each player to win sufficient game money to leave the track and enter the winner's circle. During the play of the game, as described in detail below, players are given the opportunity to answer questions about horse racing. Players who successfully answer horse racing history and trivia questions are awarded pari-mutual tickets, which can be used to place wagers in simulated horse races. Players who place successful wagers receive game money, the amount determined by the odds established for each race and the type of pari-mutual ticket wagered. Once the player has accumulated enough game money, the player may continue around the track 12, around the final turn 100 and the stretch 102, and finally, into the winner's circle 106. Thus, to prevail in the game, the player must demonstrate a knowledge of horse racing history and trivia, and must be able to calculate the cash payoff of a wager based on the odds of the race. In addition, there is an element of chance in that the player must successfully guess the winning horse or horses in each particular simulated race in order to win game money.

The number of players in the game is not fixed. Any number can play, but two to four players are preferred. Players may also play as teams or partners.

Before the game starts, one of the players is chosen as the "cashier" to provide each player with game money and to handle all transactions on behalf of the racetrack. The cashier will also prepare the game board by shuffling and placing various sets of cards on or near the game board, as follows. The "Question and Answer" cards 114 are placed face down on the winners circle 106, or, alternatively, to the side of the game board, such that the questions and answer printed on each card are not visible until the card is drawn by a player. Five stacks of Pari-Mutual Tickets, labeled WIN (FIG. 4), PLACE (FIG. 5), SHOW (FIG. 6), EXACTA (FIG. 9) or TRIFECTA (FIG. 10) are shuffled and placed face down in front of the cashier or another convenient location. A set of WALKING RING cards, shown in FIG. 7, is shuffled and placed face down on the space 108 on the game board 10 labeled "Walking Ring," while the set of cards labeled STEWARDS, shown in FIG. 8, is shuffled and placed face down on the space 110 on the game board 10 labeled "Stewards." Finally, various denominations of game money, shown in FIG. 11, is placed near the cashier.

In one embodiment, at the beginning of the game the players each throw a six-sided die to see who goes first, the player having the largest throw going first, and the player to his left going second, etc. Players may start their tokens 112 in any lane 18, 20, 22, 24 of the starting gate 16. During the play of the game, the players move around the track according to the throw of a pair of six-sided dice. On any given throw of the pair of dice, a horse token representing a given player moves forward around the track in a counter-clockwise direction. In other embodiments, different polyhedral dice, such as a fourteen-sided die, may be used.

In addition to dice, other means for randomly determining the number of spaces each player may advance his or her horse token around the board each turn may be used. For example, a wheel with a spinner rotatably mounted thereon may be used, with various numbers printed around the circumference of the wheel. In this embodiment, a player may spin the spinner, with the number of the player's moves determined by the resting position of the spinner relative to the printed numbers after the spinner comes to rest. Other types of random number generators, known to those of skill in the art, may also be employed.

After the player moves his horse token, the player will take one of several different actions determined by the square on which the horse token has landed.

If a player's horse token lands on a square labeled WIN (26, 40, 48, 58, 64, 70, 74, 82, 88 and 94), PLACE (28, 36, 42, 54, 76 and 90), or SHOW (32, 44, 50, 60, 66, 80, 86 and 96), the player will be given the opportunity to answer a Question and Answer card. The player to his or her immediate left selects the top Question and Answer card from the stack and, without revealing the answer, reads the question to the player. If that player successfully answers the question, he or she is awarded a pari-mutual ticket by the cashier, who draws the pari-mutual ticket from the top of one of the face-down stacks of pari-mutual tickets. A player landing on a win square, who successfully answers one of the question and answer cards, is awarded a WIN pari-mutual ticket. Likewise, a player landing on a PLACE square, who successfully answers a question and answer card, is awarded a PLACE pari-mutual ticket. Finally, a player landing on a SHOW square, who successfully answers a question and answer card, is awarded one of the SHOW pari-mutual tickets. As noted above, the cashier shuffles each set of pari-mutual tickets at the start of each game, so that the various denominations of pari-mutual tickets are randomly distributed throughout each stack.

If a player lands on a space labeled Walking Ring (30, 38, 52, 68, 78 and 84), the player draws one of the Walking Ring cards from the top of the face-down stack. In the embodiment of the game board shown in FIG. 1, the stack of Walking Ring cards is placed at space 108. Upon drawing the card, the player follows the instructions contained therein. The Walking Ring card is then placed face-down at the bottom of its stack, unless the card instructs the player to keep it for future use.

If a player lands on the Steward space (46), the player draws one of the Stewards cards from the top of the face-down stack. In the embodiment of the game board shown in FIG. 1, the stack of Steward cards is placed at space 110. Upon drawing the card, the player follows the instructions contained therein. The Stewards card is then placed face-down at the bottom of its stack, unless the card instructs the player to keep it for future use.

If a player lands on the Form square (62), the player takes no action and his turn is ended.

Each player starts the game with no game money. During game play, players accumulate game money as follows. First, every time a player passes the starting gate 16, the cashier will award the player a pre-determined amount of game money, for example, $100.00. Second, a player may win game money by successfully betting on simulated horse races. Optionally, players may receive game money upon drawing designated Walking Ring or Stewards cards.

A simulated horse race is run whenever a player's horse token lands on one of four racing squares 34, 56, 72, or 92. That player will announce the race, and will establish the "odds" on the race by spinning the Odds Wheel, shown in FIG. 12.

In one embodiment, the horse race is simulated by throwing seven six-sided dice, each die formed in a different color to represent different post positions or horses. For example, a horse race may be simulated by simultaneously throwing one each of a red, white, blue, yellow, green, black and orange die.

Other means for simulating a horse race may also be used. For example, a deck of cards, wherein each card bears the name and/or post position of a different horse, may be shuffled and the top three cards drawn to determine the WIN, PLACE and SHOW horses. Alternatively, chips, each bearing the name and/or post position of a different horse, may be placed into a container, mixed, and three chips randomly selected to determine the WIN, PLACE and SHOW horses.

In another embodiment, a six-page booklet may be provided in which each page is numbered one to six, and in which each page lists six possible race outcomes, numbered one to six, for a total of 36 possible race outcomes. A race may then be simulated by throwing a first die, to thereby select one of the six pages of the booklet, with a second die then thrown to select one of the six race outcomes on the selected page. Thus, for example, a first die of 3 followed by a second die of 5 would indicate the race outcome listed as number 5 on page 3.

As is apparent, this means of simulating a race may alternatively use dice of more than 6 facets, with a corresponding increase in the pages/race outcomes in the booklet. Thus, for example, a pair of fourteen sided dice may be used with a fourteen page booklet, each page of which contains fourteen possible race outcomes, for a total of 196 possible race outcomes.

In still another embodiment, a random number generator, programmed to randomly select a horse and/or post position from a predetermined pool of horses/post positions, may be employed. Other embodiments are apparent to those of skill in the art.

Any player holding at least one pari-mutual ticket may bet on the race at the established odds. A player may place one bet for each pari-mutual ticket held. Depending on their pari-mutual ticket(s), players may bet a "horse" to win, place or show, or may bet on the exacta or trifecta.

Bets may be placed by putting the pari-mutual ticket on the board in front of the player and indicating the post position color chosen for each pari-mutual ticket. In one embodiment of the game, the cashier is charged with recording the post position color for each pari-mutual ticket wagered. Alternatively, plastic or paper chips, or other similar articles, corresponding in color or other indicia to the post position, are placed on top of each pari-mutual ticket to indicate the selected post position color/horse.

Once all bets have been placed, the player whose token landed on the race square rolls the seven colored dice. The highest number rolled wins, second highest places, and third highest shows. Thus, for example, if a player rolls a red 6, a white 4, a black 3, a green 2, a blue 2, an orange 1 and a yellow 1, the red post position/horse "wins," the white post position/horse "places," and the black post position/horse "shows."

If two or more dice land on the same number, those post positions/horses are in a "dead heat" or tie for that finishing position. Thus, if the player controlling the race rolls a red 6, a white 6, a black 3, a green 2, a blue 2, an orange 1 and a yellow 1, the red and white horses tie for the win, the black horse places and the green and blue horses tie for the show.

A player who has bet with a WIN pari-mutual ticket will be "in the money" if the post position color/horse picked for that pari-mutual ticket wins. A player who placed a bet with a PLACE pari-mutual ticket will be in the money if the post position color/horse picked for that pari-mutual ticket wins or places, while a SHOW pari-mutual ticket will be in the money if the post position color/horse picked for that pari-mutual ticket wins, places or shows.

In addition to betting with WIN, PLACE or SHOW pari-mutual tickets, players may also bet with any EXACTA or TRIFECTA pari-mutual tickets in their possession. These pari-mutual tickets are awarded after drawing certain of the Walking Ring Cards. In placing a bet with an EXACTA pari-mutual ticket, a player must select the post position colors/horses that will win and place. In placing a bet with a TRIFECTA pari-mutual ticket, a player must select the post position colors/horses that will win, place and show.

Players who are in the money turn in their tickets to the cashier at the conclusion of the race, in exchange for which the cashier pays the players their winnings in game money. Players who lose their bets also turn in the wagered pari-mutual ticket(s) to the cashier, but receive no game money in exchange.

The amount of money won on each race depends on the odds established prior to the start of the race, as well as on the type of pari-mutual ticket wagered by the winning player(s) and the amount of the bet. As discussed above, prior to the start of the race, the Odds Wheel is spun to determine the odds for that race. In the embodiment shown in FIG. 12, there are eight possible odds: 2, 9-2, 1-5, 9-5, 4, 5-2, 3, and 5. The payoff for each type of bet, based on a $2.00 wager, is indicated on the Odds Wheel below the odds. Thus, for example, if the odds on a race are 5-2, a $2.00 wager to WIN will earn $8.00, while a $2.00 dollar wager on the EXACTA will earn $15.00. Winnings earned on larger bets can be calculated by the player using the figures on the Odds Wheel. Thus, for example, a $20.00 wager to WIN at 5-2 odds will earn ten times the amount shown for the $2.00 bet, or $80.00, while a $20.00 wager on the EXACTA will earn $150.00. If the amount of the calculated winnings is not an even dollar amount, the winnings are rounded up to the next dollar. Thus, for example, a $5.00 wager to WIN at 1-5 odds will pay $8.00, not $7.50.

The players continue rolling the dice and moving their tokens around the track on the board until at least one player has acquired a pre-determined amount of game money, for example, at least $10,000.00. The player or players with at least $10,000.00 continues to move around the board according to his or her turn, but may now exit the track and enter the $10,000.00 Final Turn space 100.

Each player exiting the track must stop at the Stretch space 102. Preferably, a player entering the Final Turn may stop at the Stretch regardless of the number thrown on the dice. That is, once a player has rolled a sufficiently large number of spaces to move onto the Stretch, the player may simply stop at that space and forfeit the remainder of his moves. Alternatively, players with at least $10,000.00 may be required to continue around the board until their throw of the dice will cause them to land exactly on the Stretch space. In either embodiment, once a player lands on the Stretch space, the player to his or her left draws a Question and Answer card from the top of the face down stack and reads the question to the player on the Stretch space. If the player answers correctly, he moves his token into the Winner's Circle space 106.

Once a player lands in the Winner's Circle, the player to his or her left draws a Question and Answer card from the top of the face down stack and reads the question to the player in the Winner's Circle space. If the player answers correctly, the player is the winner and the game ends. If the player answers incorrectly, his turn ends and play continues, although the player will remain in the Winner's Circle. On his next turn, the player is again given the opportunity to answer one of the Question and Answer cards. The game continues in this manner until one of the players is declared the winner.

As should be appreciated, variations of this game in addition to those discussed above are contemplated. For example, players may decide to at the onset of the game to set a time limit for answering the Question and Answer cards. Players may also decide in advance of playing the game to set a different amount of money for permitting a player to enter the Final Turn or may set a time limit for playing the game, the winner then being determined by the amount of game money won during the game. Other variations are apparent. Players may also be given the option of using game money to purchase pari-mutual tickets, introducing an additional element of strategy into the game.

Similarly, other means of calculating race odds, other than the Odds Wheel, are also contemplated. For example, a multi-faceted die, each face of which is labeled with a different odds, may be employed. In still another embodiment, a set of cards, each of which contains a different odds, may be provided. Prior to each race, the cards may be shuffled and a single card selected at random to establish the odds.

Exemplary features that may be included in the board game according to the present invention are set forth below.

The features are described with respect to a hypothetical game played by three hypothetical players using game pieces as shown in FIGS. 1–12. The invention may include one or more of the following features:

1: Preparing to Play the Horse Racing Game

Prior to beginning game play, Players One, Two and Three select positions around the game board, with Player Two to the left of Player One and Player Three to the left of Player Two. Player Three offers to act as cashier. Accordingly, Player Three shuffles the "Walking Ring" cards, examples of which are shown in FIG. 7, and places them face down on the game board 10 at 108, as shown in FIG. 1. Similarly, Player Three shuffles the Stewards cards, examples of which are shown in FIG. 8, and places them face down on the game board at 110. Next, she shuffles the "Question and Answer" cards, examples of which are shown in FIG. 3, and places them face down on the game board at 106.

Player Three next shuffles the various types of Pari-Mutual Tickets, shown in FIGS. 4, 5, 6, 9 and 10, taking care to keep each type of Pari-Mutual Ticket separate, and places them face down in five stacks near the game board. Finally, she arranges the game money near the board in a convenient location.

2: Moving a Playing Token

At the start of the game, Player One, Player Two and Player Three place their playing tokens at the starting gate, shown at 16 in FIG. 1. Each players throws a single die, with Player One throwing a six, Player Two throwing a five, and Player Three throwing a two. Because Player One threw the highest number, Player One will move first.

To start his move, Player One throws a pair of dice, with one die landing as a six and the other die landing as a one. Player One now advances his playing token counter-clockwise for seven spaces, landing his token on square 38 as shown in FIG. 1.

3: Walking Ring Cards

As described in exemplary game feature 1, Player One has moved his token to square 38, labeled "Walking Ring" in FIG. 1. Accordingly, Player One now draws a Walking Ring card from the top of the stack at 108 on the Game Board and reads the card aloud. This particular Walking Ring card says: "You overheard a hot tip—roll die. If even, receive Place Card." Player One rolls a die, throwing a four. Accordingly, Player Three, as cashier, removes a Place Pari-Mutual Ticket from the top of the stack of face-down Place Pari-Mutual Tickets and awards it to Player One. In this case, the Place ticket is for $20.00.

Player One's turn has now ended, with the turn passing to the player on his left, in this case, Player Two.

4: Stewards Cards

Player Two's playing token is still at the Starting Gate 16 as he has not yet taken his first turn. At the conclusion of Player One's turn, Player Two rolls the dice, throwing a six and a five. Player Two advances his token eleven spaces, landing at square 46, labeled Stewards.

Player Two next draws a Stewards card from the top of the deck at 110, and reads the card aloud. This particular Stewards card reads: "The Stewards ruled the video was inconclusive. No change." Accordingly, Player Two takes no action and his turn ends, passing to Player Three on his left.

5: Trivia Cards

Player Three is still at the Starting Gate 16, having not yet taken her first turn. At the conclusion of Player Two's turn, Player Three rolls the dice, throwing a five and a three. She advances her token eight spaces, landing on square 40, labeled WIN, as shown in FIG. 1.

Player One, to the immediate left of Player Three, draws a Question and Answer card from the top of stack at 106 on the game board, taking care not to show Player Three the Answer printed on the face of the card. Player One then reads the Question to Player Three, which in this case asks: "Who won the famous match race between War Admiral and Seabiscuit?" Player Three answers "Seabiscuit," which Player One confirms is the correct answer. Accordingly, Player Three as cashier awards herself a WIN Pari-Mutual Ticket, drawn from the top of the WIN Pari-Mutual Ticket Stack. In this instance, the drawn WIN ticket is for $100.00.

6: Determining Odds on a Simulated Horse Race

Play has continued as described above for several turns, with each Player earning at least one Pari-Mutual Ticket. On his next turn, Player One lands on space 72, labeled Sasha Handicap, and announces a race.

As Player One has announced the race, he sets the odds for the race by spinning the Odds Wheel, shown in FIG. 12. In this instance, the spinner stops in the section labeled "5-2." Thus, the odds on the race are 5 to 2.

7: Placing a Wager on a Simulated Horse Race

After the race is announced and the odds determined, Player Three, as Cashier, invites all players to place bets.

Player One holds a $20.00 PLACE Pari-Mutual ticket and a $10.00 Exacta Pari-Mutual ticket. Player One tells Player Three that he is betting his PLACE ticket on "Green" and his Exacta ticket on "Blue" to win and "Green" to place. Player Three records these bets on a piece of paper.

Player Two holds a $2.00 SHOW Pari-Mutual Ticket, and tells Player Three that he is betting this ticket on "Black" to show. Player Three records the bet.

Finally, Player Three holds two Pari-Mutual Tickets, a $100.00 WIN ticket and a $10.00 TRIFECTA ticket. She records her bets as "Green" to win for the WIN ticket, and "Green" to win, "Blue" to place and "Black" to show for the TRIFECTA ticket.

8: Simulating a Horse Race

Once all bets have been placed and the odds have been determined, Player One, as the player who token landed on the race square, simultaneously rolls seven dice, each a different color. In this instance, Player One rolls a red 2, a white 1, a blue 5, a yellow 5, a black 4, an orange 2 and a green 6. Thus, the order of "horses" at the finish line is: Green (6) for the WIN, Blue/Yellow (5) tie for the PLACE, and Black (4) to SHOW, followed by red/orange (2) and white (1).

9: Win Bets

Player Three bet a $100.00 WIN ticket on Green to win. Green did win, at 5-2 odds, so Player Three is "in the money." As shown on the Odds Wheels in FIG. 12, a 5-2 WIN pays $8.00 on a $2.00 ticket. Player Three bet a $100.00 ticket, so she wins $400.00 (50 time $8.00) on her WIN ticket. Player Three turns in her WIN ticket and collects $400.00 in game money, shown in FIG. 11.

10: Place Bets

Player One bet his $20.00 PLACE ticket on Green to place, and thus will be "in the money" if Green either Wins or Places. Green did not place, but won, at 5-2 odds. Although Green won, Player One wagered a Place Ticket and so will receive a "place" pay-off; in this case, $40.00 (10 times $4.00), as shown in FIG. 12. Player Three, as Cashier, takes Player One's Place Ticket and awards him two "Go For Wand" 20 dollar bills.

11: Show Bets

Player Two bet his $2.00 SHOW ticket on Black to show. Black did show, at 5-2 odds. Accordingly, Player Three, as Cashier, takes Player Two's Show ticket and awards him $3.00 as three "Northern Dancer" one dollar bills.

12: Exacta Bets

In addition to his Place wager, Player One also bet his $10.00 Exacta ticket on "Blue" to win and "Green" to place. Unfortunately for Player One, Green won and Blue placed. Accordingly, Player One surrenders his Exacta ticket to Player Three, the Cashier, but receives no game money in return.

13: Trifecta Bets

Player Three already won $400.00 on her $100.00 Win ticket. In addition, however, she wagered her $10.00 Trifecta ticket on "Green" to win, "Blue" to place and "Black" to show. As Player Three won this bet as well, also at 5-2 odds, she will receive an additional $280.00 (five times $56.00) for the Trifecta, as shown in FIG. 12.

14: Winning the Game After several turns, Player Three lands on square 92, labeled Daimon Handicap, and announces a race. A simulated race is held, in which Player Three wins enough money to become the first player to accumulate at least $10,000.00 in game money.

On her next turn, Player Three rolls a four and a three. She moves her token three spaces, to square 98, then turns into the $10,000 Final Turn 100 and stops at the Stretch 102. Player One, to the immediate left of Player Three, draws a Question and Answer card from the top of stack at 106 on the game board, taking care not to show Player Three the Answer printed on the face of the card. Player One then reads the Question to Player Three, but Player Three does not know the answer. Accordingly, Player Three's turn ends, with her playing token remaining in the Stretch.

At Player Three's next turn, Player One again draws a Question and Answer card and reads the Question to Player Three. This time, she correctly answers the Question, and advances her token to the Winner's Circle. Player One draws yet another card and reads the Question to Player Three. Player Three again answers correctly, and is declared the winner.

The above descriptions of exemplary embodiments of the horse racing game apparatus and method of play are illustrative of the present invention. Because of variations, however, which will be apparent to those skilled in the art, the present invention is not intended to be limited to the particular embodiments described above. The scope of the invention is defined in the following claims.

What is claimed is:

1. A horse-racing game, comprising;

a game board having a track layout and a winner's circle, wherein the track layout comprises a plurality of spaces and the winner's circle is connected to the track layout by at least one additional space;

at least two playing tokens;

means for randomly determining the number of spaces the playing token may advance for a turn;

a plurality of trivia cards, wherein the trivia cards define questions and answers regarding horse racing; and means for establishing betting odds of a horse winning a simulated race, wherein the means for establishing betting odds comprises a wheel divided into sections, each section representing different odds, and a spinner rotatably mounted on the wheel, wherein each section of the wheel includes a plurality of payout information indicia.

2. The horse racing game of claim 1, wherein the playing tokens depict race horses.

3. The horse racing game of claim 1, wherein the means for randomly determining the number of spaces the playing token may advance for a turn is at least one die.

4. The horse racing game of claim 1, wherein at least one of the spaces of the track layout directs a player whose playing token lands on that space to draw one of the trivia cards.

5. The horse racing game of claim 1, further comprising a plurality of action cards.

6. The horse racing game of claim 5, wherein at least one of the spaces of the track layout directs a player whose playing token lands on that space to draw one of the action cards.

7. The horse racing game of claim 1, further comprising a means for simulating a horse race.

8. The horse racing game of claim 7, wherein the means for simulating the horse race comprises a plurality of dice, each die formed of a different color to simulate a different horse post position.

9. The horse racing game of claim 7, wherein at least one of the spaces of the track layout directs a player whose playing token lands on that space to hold a simulated horse race.

10. The horse racing game of claim 7, further comprising a plurality of pari-mutual tickets.

11. The horse racing gains of claim 10, wherein the pari-mutual tickets comprise win tickets, place tickets and show tickets.

12. The horse racing game of claim 11, wherein the pari-mutual tickets further comprise exacta tickets and trifecta tickets.

13. The horse racing game of claim 10, further comprising a plurality of action cards, wherein the action cards include at least one card awarding at least one pari-mutual ticket to the player drawing the card.

14. A horse racing game comprising;

two or more playing tokens simulating horses participating in a race whereby a player of the game uses at least one of the tokens;

a game board simulating a horse racing track having at least one contiguous lane divided into a plurality of distinct spaces, wherein the token moves around the game board in the lane and wherein at least one of the distinct spaces is specially marked to indicate a starting point;

at least one distinct space separate from the lane, specially marked to indicate a stopping point;

means for randomly determining the number of spaces the token may advance for a turn;

means for testing a player's knowledge of horse racing and horse raving history;

for the plurality of distinct spaces in the lane, at least one of the distinct spaces specially marked so that when one of the playing tokens stops on the specially marked distinct space, a player's knowledge of horse racing and horse racing history is tested;

a plurality of simulated game money;

means for ordering progress of the playing tokens around the lane, whereby strategy, skill, and luck play a part in how far the tokens advance and how much simulated game money a player accumulates, so that the token to first arrive at the stopping point determines a winner of the game; and a booklet having a plurality of pages, each of the plurality of pages including a different list of simulated race outcomes.

15. The horse racing game of claim 14, further comprising means for simulating a race among two or more horses.

16. The horse racing game of claim 15, further comprising a plurality of simulated pari-mutual tickets to be awarded to a player who successfully demonstrates a knowledge of horse racing and horse racing history.

17. The horse racing gains of claim 16, wherein at least one of the distinct spaces in the contiguous lane is specially marked so that when one of the playing tokens stops on the specially marked distinct space, a horse race is simulated wherein a player holding at least one of the simulated pari-mutual tickets may place a bet on one of the horses in the race.

18. The horse racing game of claim 15, further comprising means for establishing odds of a horse winning the simulated race.

19. The horse racing game of claim 14, further comprising a plurality of randomly ordered action cards, a first side of the action cards containing instructions regarding play of the game, with the action cards arranged on the board during game play such that the instructions are face down to thereby prevent a player of the game from knowing the content of the instructions on the action card until one of the action cards is selected during play of the game.

20. The horse racing game of claim 19, wherein at least one of the distinct spaces is specially marked so that when one of the playing tokens stops on the specially marked distinct space, a player is required to draw one of the randomly ordered action cards.

21. A method of playing a horse racing game, the method comprising the steps of:

providing a game apparatus comprising a game board having a track layout and a winner's circle, wherein the track layout comprises a plurality of spaces and the winner's circle is connected to the track layout by at least one additional space, and wherein at least one of the distinct spaces is specially marked for a trivia card, at least one space is specially marked for an action card, and at least one space is specially marked for a simulated horse race;

at least two playing tokens;

at least one die;

a plurality of trivia cards, with a question and an answer regarding horse racing printed on each card;

a plurality of action cards, with instructions printed thereon;

a plurality of pari-mutual tickets;

a means for simulating a horse race; and a plurality of game money;

selecting one of the playing tokens;

rolling the die to determine how many spaces to advance the selected token, advancing the token the number of spaces associated with a number on the die, and proceeding according to one of the four following steps;

landing upon the trivia space, having an opponent select one of the trivia cards, reading the question aloud to the player landing on the trivia space, wherein the player receives one of the pari-mutual tickets if the question is answered correctly;

landing on the action space, drawing one of the action cards and following the instructions;

landing on the horse racing space, simulating a horse race wherein any player holding one of the pari-mutual tickets may bet on the race and wherein players making winning bets are awarded game money;

landing on a space other than the trivia, action or horse racing space, ending the turn and passing the die to the opponent; and continuing in accordance with the above steps for subsequent players until one of the players has accumulated an amount of game money sufficient to leave the track and enter the winner's circle, wherein odds for a simulated horse race are established by rotating a spinner on a wheel, and wherein the wheel is divided into sections, each section representing different odds, and the spinner is rotatably mounted on the wheel, wherein each section of the wheel includes a plurality of payout information indicia.

22. The method of claim 21, wherein the means for simulating the horse race comprises a plurality of dice, each die formed of a different color to simulate a different horse post position.

23. A method of playing a horse racing game, the method comprising the steps of:

providing a game apparatus comprising a game board having a track layout and a winner's circle, wherein the track layout comprises a plurality of spaces and the winner's circle is connected to the track layout by at least one additional space, and wherein at least one of the distinct spaces is specially marked for a trivia card and at least one space is specially marked for an action card;

at least two playing tokens;

at least one die;

a plurality of trivia cards, with a question and an answer regarding horse racing printed on each card; and a plurality of action cards, with instructions printed thereon;

selecting one of the playing tokens;

rolling the die to determine how many spaces to advance the selected token, advancing the token the number of spaces associated with a number on the die, and proceeding according to one of the three following steps;

landing upon the trivia space, having an opponent select one of the trivia cards, reading the question aloud to the player landing on the trivia space;

landing on the action space, drawing one of the action cards and following the instructions;

landing on a space other than the trivia or action space, ending the turn and passing the die to the opponent;

continuing in accordance with the above steps for subsequent players until one of the players has advanced his playing token into the winner's circle, wherein the game apparatus further comprises a means for simulating a horse race, a plurality of game money, and at least one distinct space on the track specially marked for the simulated, wherein the means for simulating a horse race includes a booklet having a plurality of pages, each of the plurality of pages including a different list of simulated race outcomes.

24. The method of claim 23, further comprising: the step of simulating a horse race when one of the players advances his playing token to the distinct space on the track specially marked for the simulated horse race.

25. The method of claim 23, wherein the game apparatus further comprises a plurality of pari-mutual tickets.

26. The method of claim 25, further comprising the step of awarding at least one of the pari-mutual tickets to any player who correctly answers at least one of the questions on the trivia card.

27. The method of claim 26, wherein any player awarded one of the pari-mutual tickets may bet on the horse race and wherein players making winning bets are awarded game money.

28. The method of claim 23, further comprising the step of establishing odds for the simulated horse race.

29. The method of claim 28, wherein the odds are established by rotating a spinner on a wheel, wherein the wheel is divided into sections, each section representing a different odds, and the spinner is rotatably mounted on the wheel.

30. The method of claim 28, wherein the odds are established by rolling a multi-faceted die, each facet of the die representing a different odds.

* * * * *

UNITED STATES PATENT AND TRADEMARK OFFICE

CERTIFICATE OF CORRECTION

PATENT NO. : 7,025,353 B2
APPLICATION NO. : 10/294523
DATED : April 11, 2006
INVENTOR(S) : Lydick It is certified that error appears in the above-identified patent and that said Letters Patent is hereby corrected as shown below:

In the Claims

| | |
|---|---|
| Column 11, line 58, Claim 1 | Delete ";",<br>Insert --:-- |
| Column 12, line 34, Claim 11 | Delete "gain",<br>Insert --game-- |
| Column 12, line 44, Claim 14 | Delete ";",<br>Insert --:-- |
| Column 12, line 59, Claim 14 | Delete "raving",<br>Insert --racing-- |
| Column 13, line 14, Claim 17 | Delete "gains",<br>Insert --game-- |
| Column 14, line 59, Claim 23 | Delete "simulated",<br>Insert --simulated horse race,-- |
| Column 16, line 5, Claim 29 | Delete "representing a",<br>Insert --representing-- |
| Column 16, line 10, Claim 30 | Delete "a different",<br>Insert --different-- |

Signed and Sealed this

Twenty-fourth Day of April, 2007

JON W. DUDAS
*Director of the United States Patent and Trademark Office*